US005704322A

United States Patent [19]

Grimes

[11] Patent Number: 5,704,322

[45] Date of Patent: Jan. 6, 1998

[54] ARTICULATED HOLD DOWN CLAMP FOR A DISTRIBUTOR

[76] Inventor: French H. Grimes, HC 6 Box 240 Route 603, Haywood, Va. 22722

[21] Appl. No.: 796,518

[22] Filed: Feb. 6, 1997

[51] Int. Cl.[6] ..... F02P 7/02

[52] U.S. Cl. ..... 123/146.5 A

[58] Field of Search ..... 123/146.5 A; 200/19 R; 403/4, 52

[56] References Cited

U.S. PATENT DOCUMENTS 3,861,225 1/1975 Mattson ..... 74/54

4,040,407 8/1977 Heine ..... 123/146.5 A 4,383,505 5/1983 Hanaoka ..... 123/146.5 A 4,561,796 12/1985 Hanaoka ..... 123/146.5 A X

*Primary Examiner*—Tony M. Argenbright

*Attorney, Agent, or Firm*—Donavon Lee Favre

[57] ABSTRACT

The present disclosure is directed to an articulated clamp for maintaining a distributor housing in a fixed rotational position on an engine block. The one piece articulated clamp allows the distributor to be removed and replaced very fast while maintaining the correct engine timing. The articulation allows for variations in engine block mounting surfaces without the need to reposition the articulated mounting clamp on the distributor shaft housing.

3 Claims, 3 Drawing Sheets

ARTICULATED HOLD DOWN CLAMP FOR A DISTRIBUTOR

BACKGROUND OF THE INVENTION

1. Field of the Invention

The present invention is directed to an articulated clamp designed to hold a distributor in fixed position with respect to an engine block.

2. Description of the Related Art

U.S. Pat. No. 3,861,225 Mattson (1975) discloses an ignition distributor rotatably mounted in the block of an engine whose timing is to be adjusted. A bifurcated arm is affixed to the distributor adjacent the engine block. A stud is rotatablyl mounted on the engine block including a cam affixed thereto to cooperate with the bifurcated portion of the arm to move the arm angularly through a predetermined angular movement. Means on the stud cooperate with a hand tool to control the angular movement of the arm and means cooperate with the stud to lock the parts in a fixed position.

U.S. Pat. No. 4,040,407 Heine (1977) discloses the housing of a breaker-distributor formed with a shaft element inserted in motor block, with a shaft thereon which is engaged by a claw surrounding the flange and gripping therearound. The claw is screwed to the motor to clamp the housing against the motor block. To permit minor adjustment for changes of relative position of the distributor and the motor block upon tightening of the clamping bolt, the attachment shaft is formed with adjustment means acting thereon to permit slight relative displacement of the shaft with respect to the motor block. The adjustment means may be a claw with threaded holes through which bolts are threaded engaging the distributor housing eccentrically to effect rotation about the shaft.

U.S. Pat. No. 4,383,505 Hanaoka (1983) discloses a device for preventing a fixed angle change of a distributor in relation to an engine. The distributor includes a cylindrical rotor housing with a flange extending from the cylindrical portion. The cylindrical portion is rotatably fitted into a hole formed in the engine and the flange is seated on the engine. The flange is firmly fixed to the engine with a bolt which extends through the flange into the engine.

A distributor shaft claw similar to that of Heine has recently been introduced onto the market by Barnes, photograph enclosed. The claw of Barnes differs from that of Heine in that a single bolt goes through holes adjacent the outer ends of the fingers of the claw to tighten the claw around the distributor housing. The toes of the claw are spaced apart a distance equal to the diameter of the distributor housing and surround a split ring which is locked onto the distributor housing with a set screw.

Another method of holding a distributor in place was to provide recesses in a distributor shaft housing flange which mated with protrusions with protrusions on the ends of the toes of a hold down claw.

SUMMARY OF THE INVENTION

The present invention is directed to an articulated clamp for maintaining a distributor in a preselected position on an engine block. The articulated clamp comprises a clamp positioned on the distributor shaft, a mounting bracket for attachment to the engine block and an articulation between the clamp and the mounting bracket to compensate for variations in the mounting surface on the engine block for the distributor. By use of the articulated clamp of the present invention, a distributor can be mounted on an engine block without aligning a bracket or flange extending from the distributor shaft housing with the mounting surface on the engine block. Distributors mounted in the articulated clamp of the present invention can be moved from engine to engine without compensating for variations in engine block mounting surfaces and without attempting to align recesses in a distributor flange with protrusions on the ends of the toes of a hold down claw. The present invention is particularly useful where time for installing a distributor is of the essence, such as a replacement during an car race. Another advantage of the present invention is that is does not exert a torque on the distributor shaft housing.

The following is a description of a specific preferred embodiment, and is not intended to limit the invention which is directed to an articulated one piece distributor clamp which will compensate for variations in distributor mounting surfaces, will not require aligning and assembling distributor clamp parts during distributor mounting and which will prevent torque on the distributor shaft when the distributor is mounted.

The preferred articulated clamp for maintaining a distributor in a preselected position on an engine block comprises a locking ring to be positioned around the distributor drive shaft housing. A slit extending through the width of the locking ring allows the diameter of the ring to be expanded and contracted for locking the distributor shaft housing in place when the timing is correct and turning the distributor shaft housing to adjust the timing and to remove the distributor from the articulated clamp. To this end threads are positioned in the locking ring on one side of the slit and a cylindrical recess is positioned on the other side of the slit. A tightening screw has a head positioned in the cylindrical recess and has a male threaded portion in mating relationship with the threads in the locking ring. Tightening the screw will lock the ring to the distributor shaft housing and loosening the screw will allow movement of the locking ring with respect to the distributor drive shaft housing. Two cylindrical openings perpendicular to the distributor shaft housing, in opposed outer circumferential surfaces of the locking ting, form bearings. A forked claw having two toes is positioned partially around the locking ring. Threaded openings are adjacent each end of the toes of the claw, each threaded opening is aligned with each of the corresponding bearings in the locking ring. Threaded bearing screws are screwed into each of the threaded openings. Cylindrical protrusions on the ends of each of the bearing screws extend into each of the corresponding bearings forming an articulation whereby the claw can rotate sufficiently with respect to the clamping ring to compensate for variations in engine block surfaces in the distributor mounting area.

BRIEF DESCRIPTION OF THE DRAWINGS

FIG. 8 shows a distributor mounted on an engine block surface which angles downwardly from the surface the locking ring is resting on.

FIG. 9 shows a distributor mounted on an engine block surface which angles upwardly from the surface the locking ring is resting on.

DESCRIPTION OF THE PREFERRED EMBODIMENTS

Figure 1:
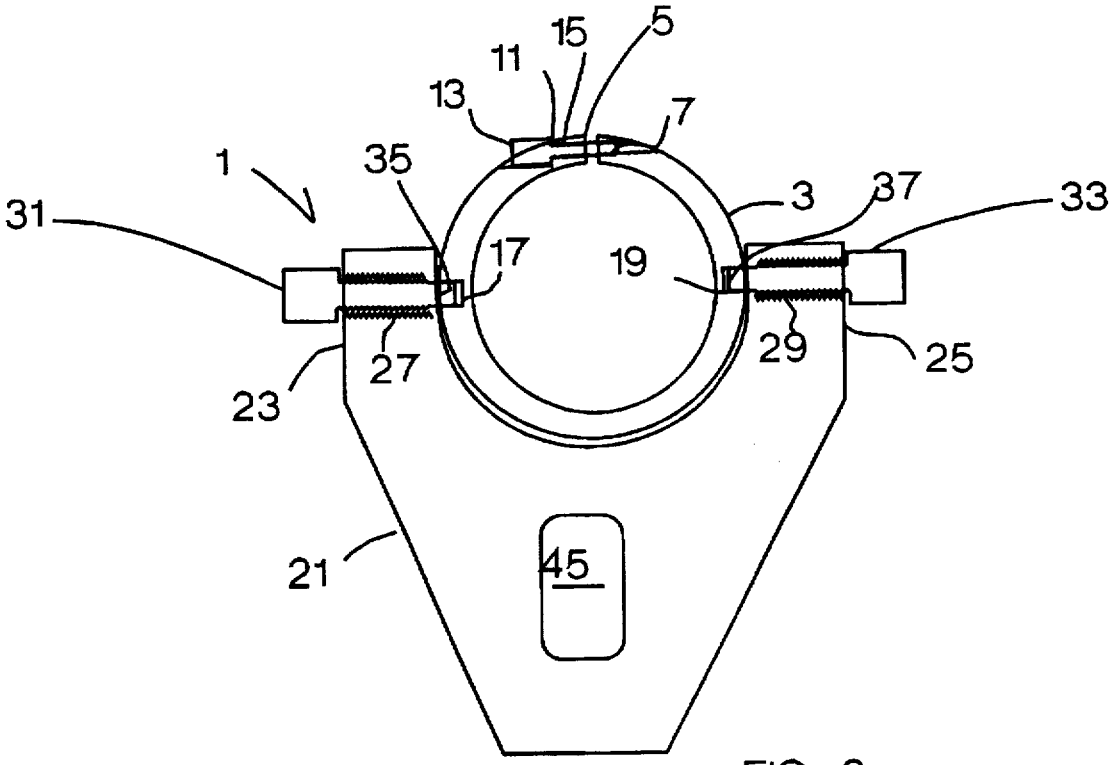
FIG. 1 is a top view of the articulated distributor clamp of the present invention.
Figure 2:
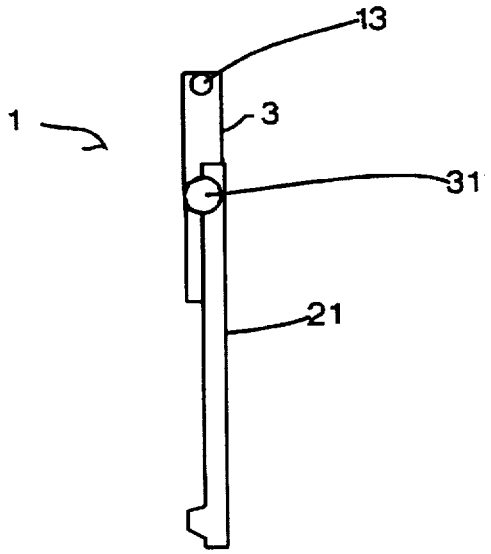
FIG. 2 is a side view of the clamp of FIG. 1
Figure 3:
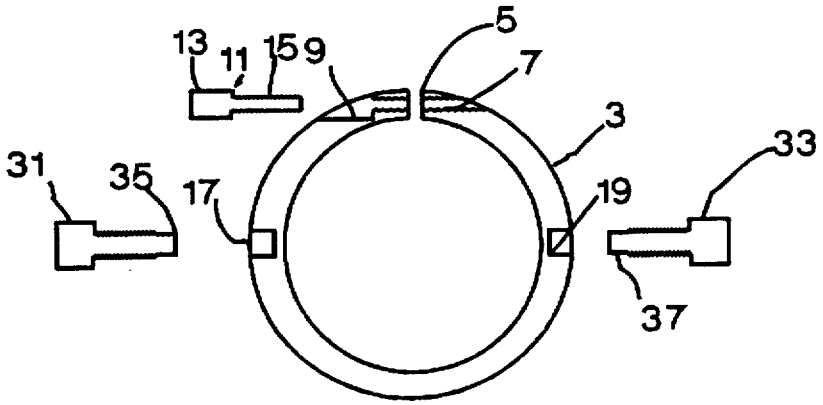
FIG. 3 is a top view of the clamping ring of FIG. 1 including the bearing screws and the tightening screw.
Figure 4:
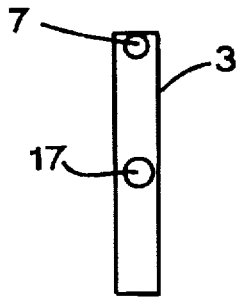
FIG. 4 is a side view of the clamping ring of FIG. 3.

Turning now to the drawings and more particularly to FIG. 1 there is shown an articulated clamp 1 for maintaining a distributor shaft housing in a preselected position on an engine block having a locking ring 3 (see FIG. 2) to be positioned around the distributor drive shaft housing. A slit 5 extends through the width of the locking ring 3 and allows the diameter of the ring 3 to be expanded and contracted for locking the distributor shaft housing in place when the timing is correct and turning the distributor shaft housing to adjust the timing and to remove the distributor from the articulated clamp 1. To this end threads 7 are positioned in the locking ring on one side of the slit 5 and a cylindrical recess 9 is positioned on the other side of the slit 5 (see FIG. 2). A tightening screw 11 has a head 13 positioned in the cylindrical recess and has a male threaded shank 15 in mating relationship with the threads in the locking ring 3. Tightening the screw 11 will lock the ring 3 to the distributor shaft housing and loosening the screw 11 will allow movement of the locking ring 3 with respect to the distributor drive shaft housing. Two cylindrical openings 17 and 19 perpendicular to the distributor shaft housing, in opposed outer circumferential surfaces of the locking ring 3, form bearings. A forked claw 21 having two toes 23 and 25 is positioned partially around the locking ring 3. Threaded openings 27 and 29 are positioned adjacent each end of the toes of the claw, each threaded opening is aligned with each of the corresponding beatings 17 and 19 in the locking ring 3. Threaded beating screws 31 and 33 are screwed into each of the threaded openings 27 and 29. Cylindrical protrusions 35 and 37 on the ends of each of the bearing screws 31 and 33 extend into each of the corresponding bearings 17 and 19 forming an articulation whereby the claw 21 can rotate sufficiently with respect to the clamping ring 3 to compensate for variations in engine block surfaces in the distributor mounting area.

Figure 5:
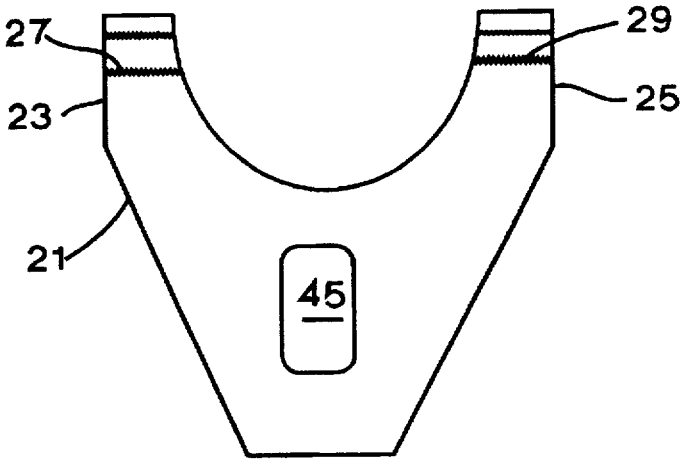
FIG. 5 is a top view of the claw of FIG. 1.
Figure 6:
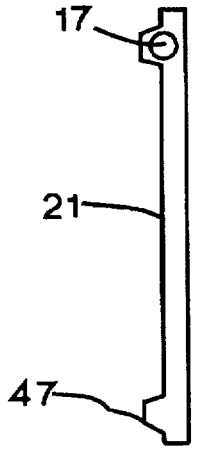
FIG. 6 is a side view of the claw of FIG. 5.
Figure 7:
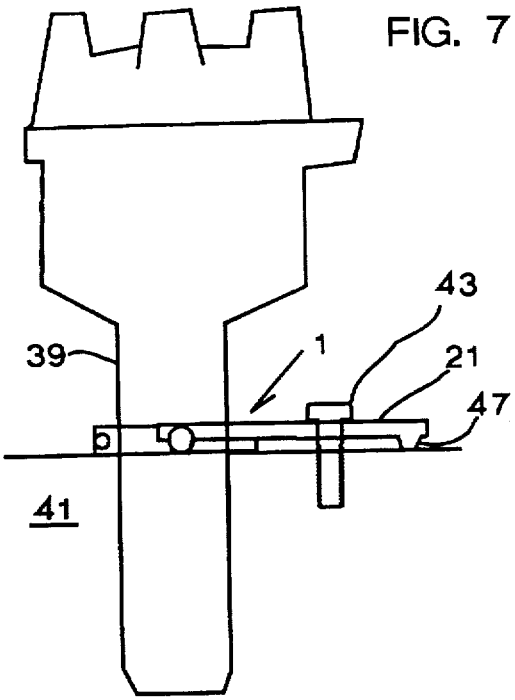
FIG. 7 shows a distributor mounted on a flat mounting surface of an engine block.
Figure 8:
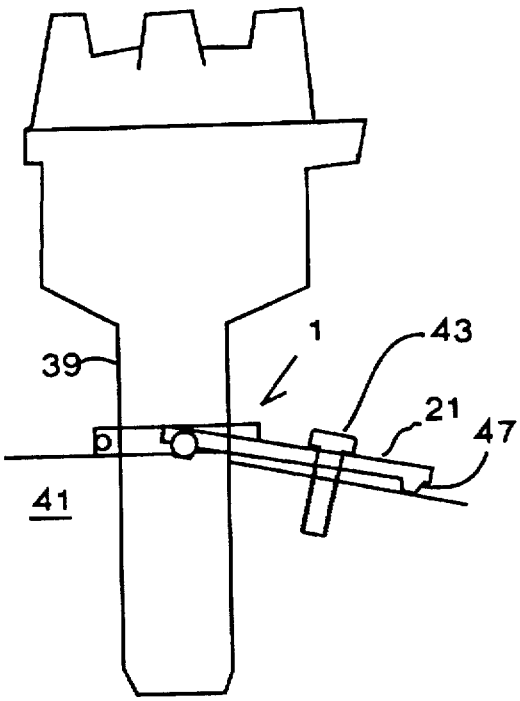
Figure 9:
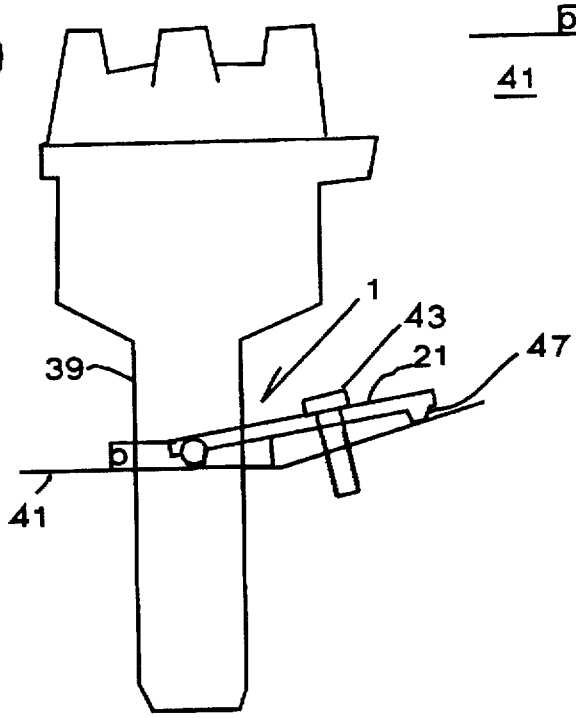

Turning now to FIGS. 7, 8 and 9, there is shown the mounting of a distributor shaft housing 39 to an engine block 41 using the articulated clamp 1. The articulated clamp is held to engine block 41 by bolt 43 through opening 45 of claw 21 (see FIGS. 1 and 5). Claw 21 pivots on engine block 41 on pivot 47. FIG. 7 shows a distributor shaft housing 39 mounted on a flat mounting surface of engine block 41. FIG. 8 shows a distributor shaft housing 39 mounted on an engine block 41 which angles downwardly from the surface the locking ring 3 is resting on. FIG. 9 shows a distributor shaft housing 39 mounted on an engine block 41 which angles upwardly from the surface the locking ring 3 is resting on.

Various known equivalents can be substituted for the elements of the present invention and still come within the literal language of the claims. For example a two part split ring can be employed as the clamping or locking ring.

I claim:

1. An articulated clamp for maintaining a distributor shaft housing in a preselected position on an engine block comprising a clamp positioned on the distributor shaft housing, a mounting bracket for attachment to the engine block and an articulation between the clamp and the mounting bracket to compensate for variations in the mounting surface for the distributor.

2. An articulated clamp for maintaining a housing in a preselected position in a mounting area on an engine block comprising a locking ring to be positioned around the housing, a slit extending through the width of the locking ring to allow the diameter of the ring to be expanded and contracted, threads in the locking ring on one side of the slit and a cylindrical recess on the other side of the slit, a tightening screw having a head positioned in the cylindrical recess and having a male threaded portion in mating relationship with the threads in the locking ring whereby tightening the screw will lock the ring to the housing and loosening the screw will allow movement of the locking ring with respect to the housing, two cylindrical openings, in opposed outer circumferential surfaces of the locking ring, forming bearings, a forked claw having two toes positioned partially around the locking ring, threaded openings adjacent each end of the toes of the claw, each threaded opening aligned with each of the corresponding bearings in the locking ring, threaded bearing screws positioned in each of the threaded openings, cylindrical protrusions on the ends of each of the bearing screws extending into each of the corresponding bearings forming an articulation whereby the claw can rotate sufficiently with respect to the clamping ring to compensate for variations in surfaces in a mounting area.

3. An articulated clamp for maintaining a distributor shaft housing in a preselected position in a mounting area on an engine block comprising, a locking ring to be positioned around the distributor drive shaft housing, a slit extending through the width of the locking ring to allow the diameter of the ring to be expanded and contracted, threads in the locking ring on one side of the slit and a cylindrical recess on the other side of the slit, a tightening screw having a head positioned in the cylindrical recess and having a male threaded shank in mating relationship with the threads in the locking ring whereby tightening the screw will lock the ring to the distributor shaft housing and loosening the screw will allow movement of the locking ring with respect to the distributor drive shaft housing, two cylindrical openings, in opposed outer circumferential surfaces of the locking ring, forming bearings, a forked claw having two toes positioned partially around the locking ring, threaded openings adjacent each end of the toes of the claw, each threaded opening aligned with each of the corresponding bearings in the locking ring, threaded bearing screws positioned in each of the threaded openings, cylindrical protrusions on the ends of each of the bearing screws extending into each of the corresponding bearings forming an articulation whereby the claw can rotate sufficiently with respect to the clamping ring to compensate for variations in engine block surfaces in the distributor mounting area.

* * * * *